US006000115A

United States Patent [19]

Takagi et al.

[11] Patent Number: 6,000,115

[45] Date of Patent: Dec. 14, 1999

[54] SHELL LOCK SEAMING MACHINE

[75] Inventors: Kazuaki Takagi; Yukinori Suzuki, both of Nagoya, Japan

[73] Assignees: Sango Co., Ltd; Sanko Seiki Co. Ltd, both of Nagoya, Japan

[21] Appl. No.: 08/976,485

[22] Filed: Nov. 24, 1997

[30] Foreign Application Priority Data

Nov. 28, 1996 [JP] Japan ..... 8-317256

[51] Int. Cl.[6] ..... B23P 11/00

[52] U.S. Cl. ..... 29/243.5; 29/559

[58] Field of Search ..... 29/559, 243.5, 29/243.517, 515, 509

[56] References Cited

U.S. PATENT DOCUMENTS

| | | | |
|---|---|---|---|
| 3,890,689 | 6/1975 | Copas | 29/559 |
| 4,131,007 | 12/1978 | Laundy . | |
| 4,513,596 | 4/1985 | Usher . | |
| 4,559,689 | 12/1985 | Ladouceur | 29/243.517 |
| 5,408,737 | 4/1995 | Mailey et al. | 29/559 |
| 5,720,095 | 2/1998 | Lennartsson | 29/509 |

FOREIGN PATENT DOCUMENTS

| | | |
|---|---|---|
| 1-18524 | 1/1989 | Japan . |
| 1-278909 | 11/1989 | Japan . |
| 03204128 | 9/1991 | Japan . |
| 6-269884 | 9/1994 | Japan . |

*Primary Examiner*—David A. Scherbel
*Assistant Examiner*—Daniel G. Shanley
*Attorney, Agent, or Firm*—Pillsbury Madison & Sutro, LLP

[57] ABSTRACT

To support a shell case having a different shape by support mechanisms in a shell lock seaming machine, the support mechanisms are disposed on both the sides of the opening edges of the shell case and a plurality of support members are provided with each of the support mechanisms, the plurality of support members being locked to the inner surface of both the opening edges of the shell case, wherein the plurality of support members can advance and retreat in the axial direction of the shell case as well as at least one of the plurality of support members is movable in a direction perpendicular to the axial center of the shell case.

3 Claims, 11 Drawing Sheets

SHELL LOCK SEAMING MACHINE

BACKGROUND OF THE INVENTION

1. Field of the Invention

The present invention relates to a shell lock seaming machine, and more specifically, to a shell lock seaming machine for winding a sheet member around the outer periphery of a shell case.

2. Description of the Related Art

Conventionally, there have been used shell lock seaming machines which employ a so-called over-winding method by which a sheet member is wound around the outer periphery of a shell case used as a silencer to reduce the noise created by an internal combustion engine in order to enhance the noise insulating properties of the silencer and make the silencer look more attractive.

The over-winding method will be schematically described with reference to FIG. 11A to FIG. 11F. First, a metal sheet member 100 shown in FIG. 11A is wound to a cylindrical shape as shown in FIG. 11B and both the ends thereof are coupled with each other by a lock seam 101; flanges 103, as shown in FIG. 11, are formed to both the opening edges of the shell case 102; contents 104 composed of barrier plates, end plates and the like to which an inner pipe is fixed are inserted from one of the opening edges as shown in FIG. 11D; thereafter, a sheet member 105 is fed below the shell case 102 and bent along the lower half of the shell case 102 by moving a pair of presser plates 106 upward as well as both the ends of the sheet member 105 are raised as shown in FIG. 11E; and then both the ends of the sheet member 105 are coupled with each other by a lock seam 107 as shown in FIG. 11F to thereby form a double-walled shell case.

At the above step at which the sheet member 105 is wound around the outer periphery of the shell case 102, there has been conventionally employed, as shown in FIG. 12A and FIG. 12B, a mechanism for supporting the shell case 102 which is arranged such that a pair of mandrels 108, 109 are disposed in confrontation with each other, the shell case 102 is located between the mandrels 108, 109 by a robot or the like as shown in FIG. 12A, thereafter both the mandrels 108, 109 are inserted into the shell case 102 from both the opening edges thereof to thereby support the shell case 102 as shown in FIG. 12B (for example, JP-A-06-269884).

The outer peripheral shape of the conventional mandrels 108, 109 is exclusive to the shape of both the opening edges of the shell case 102 to be processed. Thus, when a shell case having a different opening diameter is supported, the above mandrels must be replaced with mandrels whose shape corresponds to the different opening diameter. As a result, to make silencers having various types of sections, pairs of mandrels as many as the number of the sections must be prepared and a setup process for the mandrels is required.

Accordingly, the cost of mandrels and a setup cost therefor are incurred in this arrangement, and the efficiency of the operation is lowered due to the time consumed by the setup.

An object of the present invention is to provide a shell lock seaming machine which has a shell case support mechanism capable of supporting shell cases having various types of sections without the need of setup to thereby increase productivity when many types of shell cases are made by mixture.

SUMMARY OF THE INVENTION

To solve the above problem, according to a first aspect of the present invention, there is provided a shell lock seaming machine in which both the opening edges of a shell case having been fed are supported, a sheet member is wound around the outer periphery of the shell case and both the wound ends of the sheet member are lock seamed to thereby form a double-walled shell case, the shell lock seaming machine comprising support mechanisms disposed on both the sides of the opening edges of the shell case; and a plurality of support members provided with each of the support mechanisms, the plurality of the support members being locked to the inner surface of both the opening edges of the shell case, wherein the plurality of support members can advance and retreat in the axial direction of the shell case as well as at least one of the plurality of support members is movable in a direction perpendicular to the axial center of the shell case.

At least one of the plurality of support members provided with each of the support mechanisms is moved in the direction perpendicular to the axial center of the shell case so that the support members come into contact with the inner peripheral surface of the shell case to be fed.

If the shell case to be fed has a large sectional diameter, the at least one support member is moved outward of the direction perpendicular to the axial center of the shell case, whereas when the shell case to be fed has a small sectional diameter, the at least one support member is moved inward of the direction perpendicular to the axial center.

With this operation, shell cases having a different sectional diameter and further shell cases having various types of a sectional shape such as a circular shape, an oval shape, a rectangular shape and the like can be supported.

According to a second aspect of the present invention, there is provided a shell lock seaming machine arranged such that the shell case is approximately horizontally disposed and the plurality of support members are composed of a support member which is disposed just above the axial center of the shell case and advances and retreats only in the direction of the axial center, a support member which is disposed just below the axial center and advances and retreats in the direction of the axial center as well as in a vertical direction and other support members which are disposed at intermediate positions and advance and retreat in the direction of the axial center as well as move on a surface perpendicular to the axial center of the shell case.

In the second aspect, since the shell case can be further supported at the upper inner surface, the lower inner surface and the intermediate inner surface thereof, the shell case can be more stably supported.

According to a third aspect of the present invention, the other support members in the second aspect are composed of two support members which are located symmetrically with respect to a vertical surface passing through the axial center of the shell case as well as located below a horizontal surface passing through the axial center of the shell case.

In the third aspect, since the shell case can be supported at four points on the upper inner surface, the lower inner surface and both the sides of the inner surface below the axial center, the shell case can be more stably supported as well as the shell case can be centered.

BRIEF DESCRIPTION OF THE DRAWINGS

FIG. 12A and FIG. 12B are views showing how a shell case is supported by conventional mandrels, wherein FIG. 12A shows a state before the shell case is supported and FIG. 12B shows a state after the shell case is supported.

DESCRIPTION OF THE PREFERRED EMBODIMENT

Figure 1:
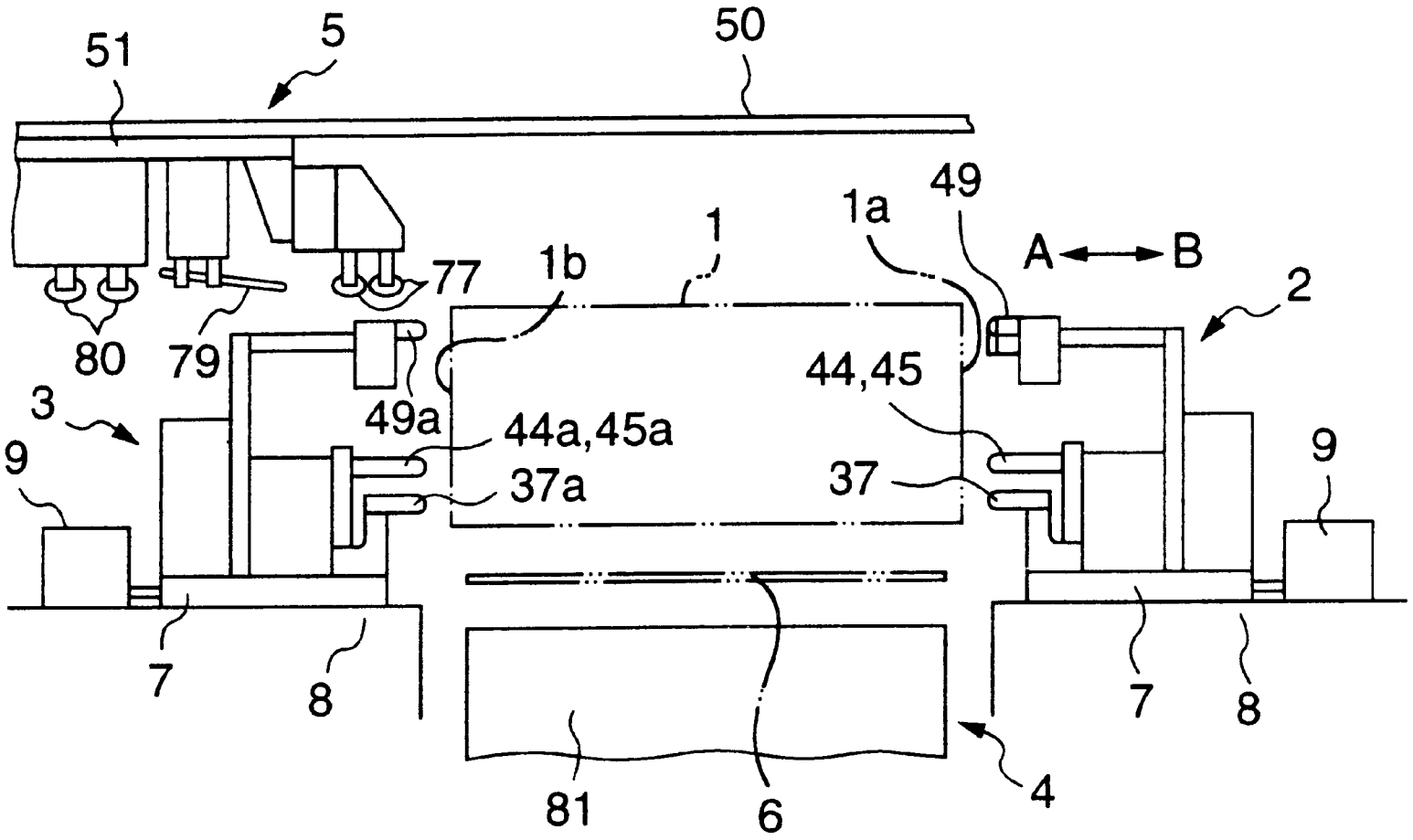
FIG. 1 is a schematic front elevational view showing an embodiment of a shell lock seaming machine according to the present invention viewed from a sheet member feed side.

An embodiment according to the present invention will be described with reference to FIG. 1 to FIG. 10. FIG. 1 is a schematic front elevational view of an embodiment of a shell lock seaming machine according to the present invention viewed from a sheet member feed side. The shell lock seaming machine is arranged such that shell case support mechanisms 2, 3 are disposed in opposed relation to each other on sides of both the opening edges 1*a*, 1*b* of a shell case 1, which has been lock seamed to a cylindrical shape by a conventional method and fed to the shell lock seaming machine with its axial center maintained in a horizontal state, a lower die apparatus 4 is disposed below the shell case 1 and a roll carriage 5 is disposed above the shell case support mechanism 3. In FIG. 1, a metal plate 6 is to be wound around the outer peripheral surface of the shell case 1 afterwards.

The right shell case support mechanism 2 shown in FIG. 1 will be described in detail with reference to FIG. 1 to FIG. 6.

In FIG. 1, an adjustable base 7 is disposed on a base 8 so that it advances and retreats in the axial direction of the shell case 1 having been fed horizontally. The adjustable base 7 is driven by drive means 9 such as a hydraulic cylinder or the like so as to advance and retreat in the direction of an arrow A-B.

Figure 4:
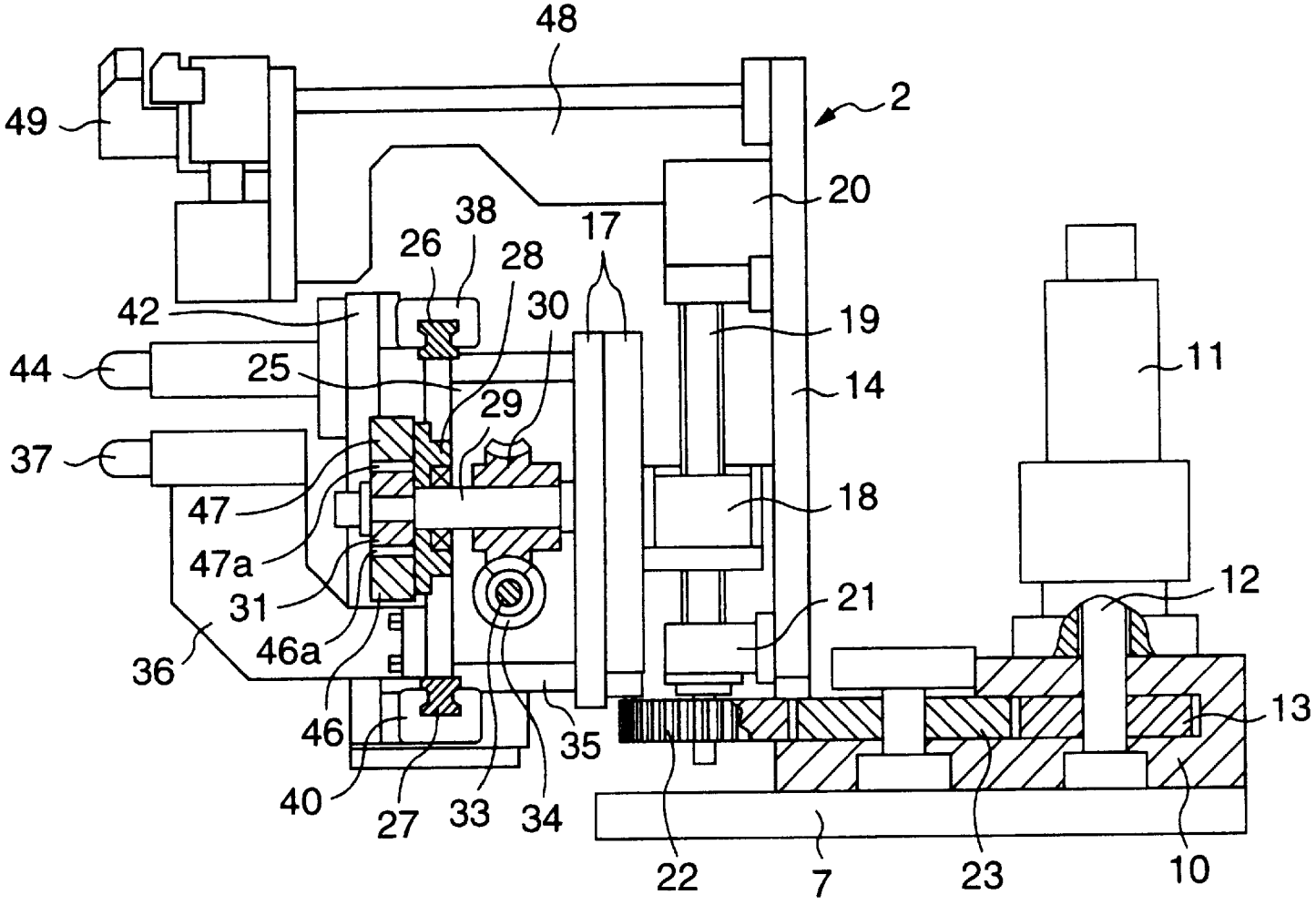
FIG. 4 is a side sectional view showing a shell case support mechanism according to the present invention.

As shown in FIG. 4, a servo motor 11 acting as rotational drive means is disposed on the adjustable base 7 through a member 10 and a drive gear 13 composed of a spur gear is fixed to the drive shaft 12 of the servo motor 11.

Figure 6:
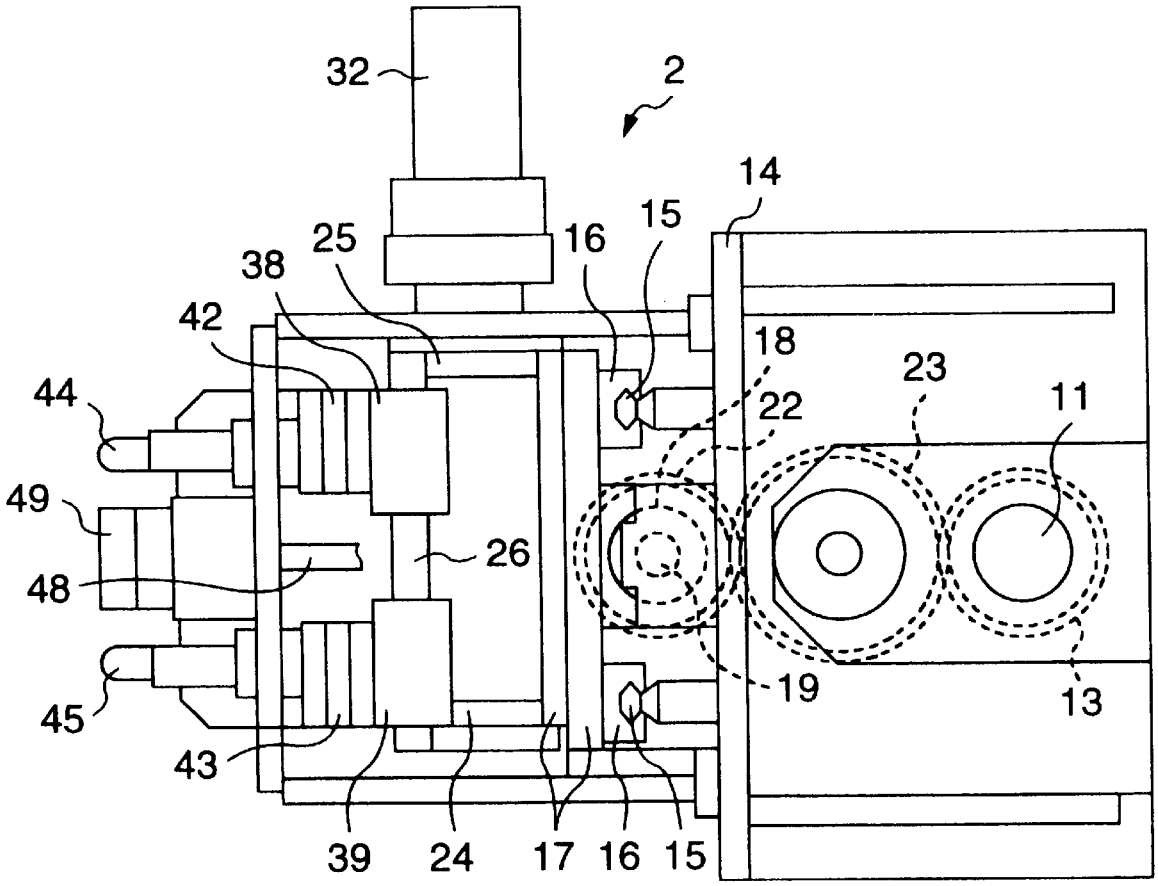
FIG. 6 is a plan view of the shell case support mechanism in FIG. 4.

A support plate 14 is arranged above the adjustable base 7 in a standing condition and as shown in FIG. 6, two first guide rails 15, 15 are fixed on both the sides of the front surface of the support plate 14 in a vertical direction. Lifting/lowering members 16, 16 are slidingly engaged with the first guide rails 15, 15 and lifting/lowering plates 17 are fixed to both the lifting/lowering members 16, 16. As shown in FIG. 4, a nut member 18 having a female screw engraved thereto in the vertical direction is fixed to the rear surface of the lifting/ lowering plates 17 at the center thereof.

A screw shaft 19 is disposed forward of the support plate 14 at the center thereof in the vertical direction, the upper and lower portions of the screw shaft 19 are rotatably supported by members 20, 21 disposed to the support plate 14 and the nut member 18 is screwed to the screw shaft 19. A follower gear 22 composed of a spur gear is fixed to the lower end of the screw shaft 19 so that the rotation of the drive gear 13 is transmitted to the follower gear 22 through an intermediate gear 23.

Accordingly, when the drive gear 13 is normally or reversely rotated by the rotational drive means 11, the screw shaft 19 is normally or reversely rotated to thereby cause the nut member 18 and the lifting/lowering plates 17 to move upward and downward.

Figure 5:
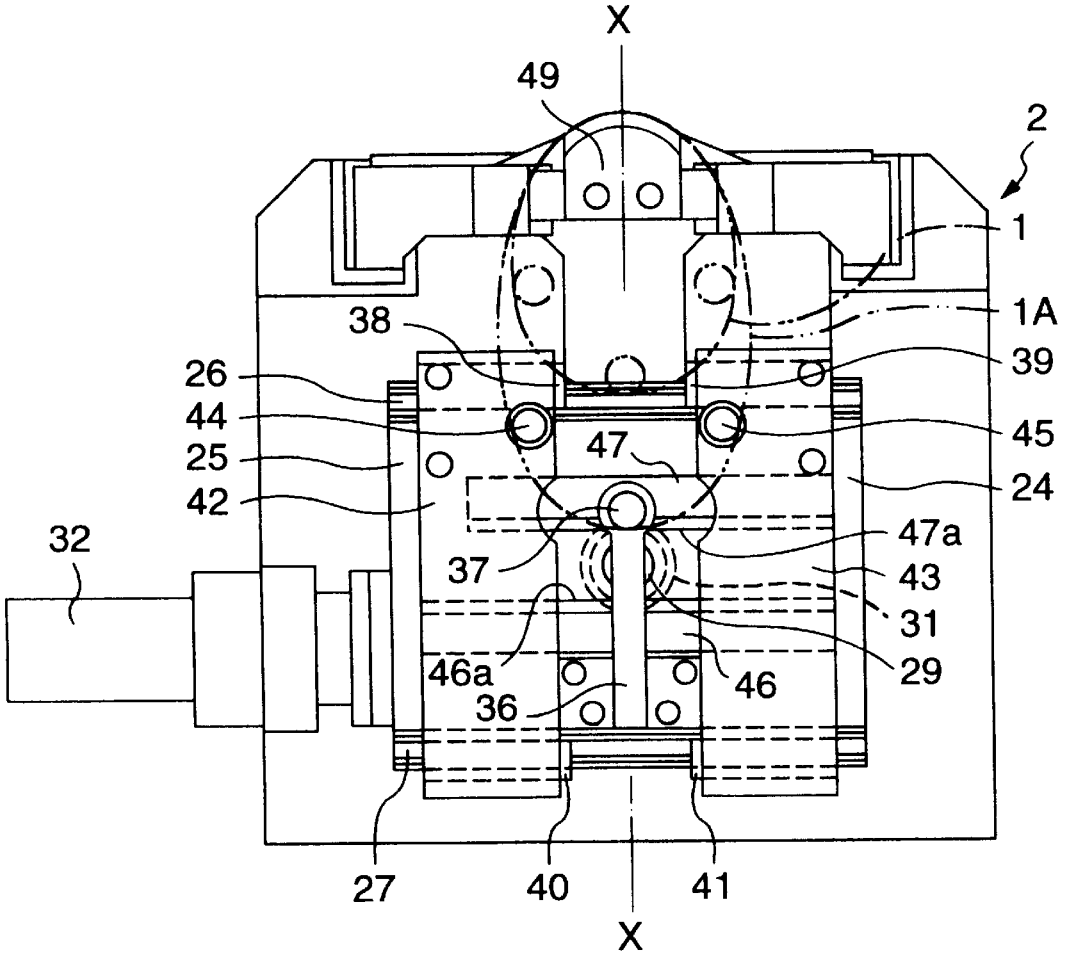
FIG. 5 is a view observed from a left side in FIG. 4.

As shown in FIG. 6, arm plates 24, 25 are protruded from the front surface on both the sides of the lifting/lowering plates 17 and as shown in FIG. 5, second guide rails 26, 27 are disposed between both the arm plates 24, 25 in a horizontal direction. As shown in FIG. 4, a support lever 28 is fixed between the upper and lower guide rails 26, 27 so as to hang across both the arm plates 24, 25. As shown in FIG. 5, between the support lever 28 and the lifting/lowering plates 17, a rotary shaft 29 is located on a vertical line X—X passing through the axial center of the shell case 1 having been fed so that it can be horizontally rotated.

A worm wheel 30 is fixed to the rotary shaft 29 as well as a pinion 31 is fixed to the extreme end thereof.

A servo motor 32 acting as rotational drive means is fixed to one of the arm plates 24, 25 or the arm plate 25 (see FIG. 6) and as shown in FIG. 4 a worm 34 which is meshed with the worm wheel 30 is fixed to the rotary shaft 33 of the servo motor 32.

A support lever 35 is protruded from the front surface of the lifting/lowering plates 17 (see FIG. 4), a support arm 36 is fixed to the extreme end thereof on the line X—X and a support pin 37 acting as first support member is protruded forward from the extreme end of the support arm 36 on the line X—X. The periphery of the extreme end portion of the support pin 37 is tapered to a spherical surface so that the support pin 37 can be easily inserted into the shell case 1.

As shown in FIG. 5, two upper moving members 38, 39 are disposed at symmetrical positions with respect to the line X—X and slidingly engaged with the second guide rail 26 disposed on the upper side, and two lower moving members 40, 41 are disposed at symmetrical positions with respect to the line X—X and slidingly engaged with the second guide rail 27 disposed on the lower side.

Figure 3:
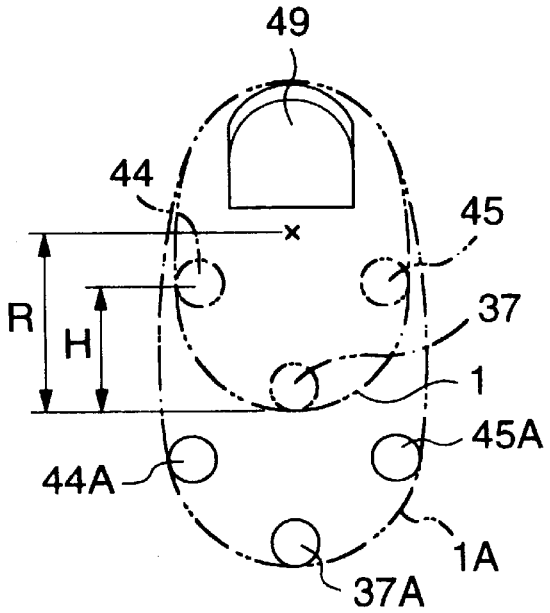
FIG. 3 is a view explaining the movement of a support member according to the present invention.

As shown in FIG. 5, a left moving plate 42 is fixed between the upper moving member 38 and the lower moving member 40 and a right moving plate 43 is fixed between the upper moving member 39 and the lower moving member 41. A support pin 44 acting as a second support member is protruded from the upper front surface of the left moving plate 42 and a support pin 45 acting as a third support member is protruded from the upper front surface of the right moving plate 43. Both the support pins 44, 45 are disposed at symmetrical positions with respect to the line X—X. The peripheries of the extreme end portions of these support pins 44, 45 are tapered to spherical surfaces likewise the first support pin 37. As shown in FIG. 3, the positions of both the support pins 44, 45 are set such that a vertical distance H from the first support pin 37 to the support pins 44, 45 is shorter than a vertical radius R of the shell case 1 to be supported.

As shown in FIG. 5, a first rack 46 is horizontally fixed to the back surface of the left moving plate 42 and teeth 46*a* engraved on the upper surface thereof are meshed with the lower side of the pinion 31. Further, a second rack 47 is horizontally fixed to the back surface of the right moving plate 43 and teeth 47*a* engraved on the lower surface thereof are meshed with the upper side of the pinion 31.

Therefore, when the worm 34 is rotated in one direction by the servo motor 32, the pinion 31 is rotated in the one direction through the worm wheel 30 and the rotary shaft 29 and the first rack 46 and the second rack 47 are moved in opposite directions by the same amount so that the second support member 44 becomes nearer to the third support member 45. Further, when the worm 34 is rotated in the other direction, the first rack 46 and the second rack 47 are moved in opposite directions by the same amount so that the second support member 44 is separated from the third support member 45.

As shown in FIG. 4, an arm 48 is protruded from the upper front surface of the support plate 14 and a hanger 49 acting as a fourth support member is protruded from the extreme end thereof on the line X—X. As shown in FIG. 5, the upper surface of the fourth support member 49 is curved in a right to left direction as well as the upper extreme portion thereof is inclined downward as shown in FIG. 4 so that it can be easily inserted into the shell case 1.

The extreme end surfaces of the above four support members 37, 44, 45 and 49 are located on the same vertical surface.

The left shell case support mechanism 3 shown in FIG. 1 is arranged similarly to the right shell case support mechanism 2 and they are disposed in confrontation with each other as shown in FIG. 1. The left shell case support mechanism 3 includes support members 37*a*, 44*a*, 45*a* and 49*a* which correspond to the respective support members 37, 44, 45 and 49 of the right shell case support mechanism 2. The portions of the left shell case support mechanism 3 which are similar to those of the right shell case support mechanism 2 are denoted by the same numerals as used in the right shell case support mechanism 2.

Next, the roll carriage 5 shown in FIG. 1 will be described in detail with reference to FIG. 1 and FIG. 8 to FIG. 10.

In FIG. 1, a rail 50 is horizontally disposed above the shell case 1 having been fed and on the line X—X along the axial center of the shell case 1 and a support plate 51 is slidingly provided therewith.

Figure 8:
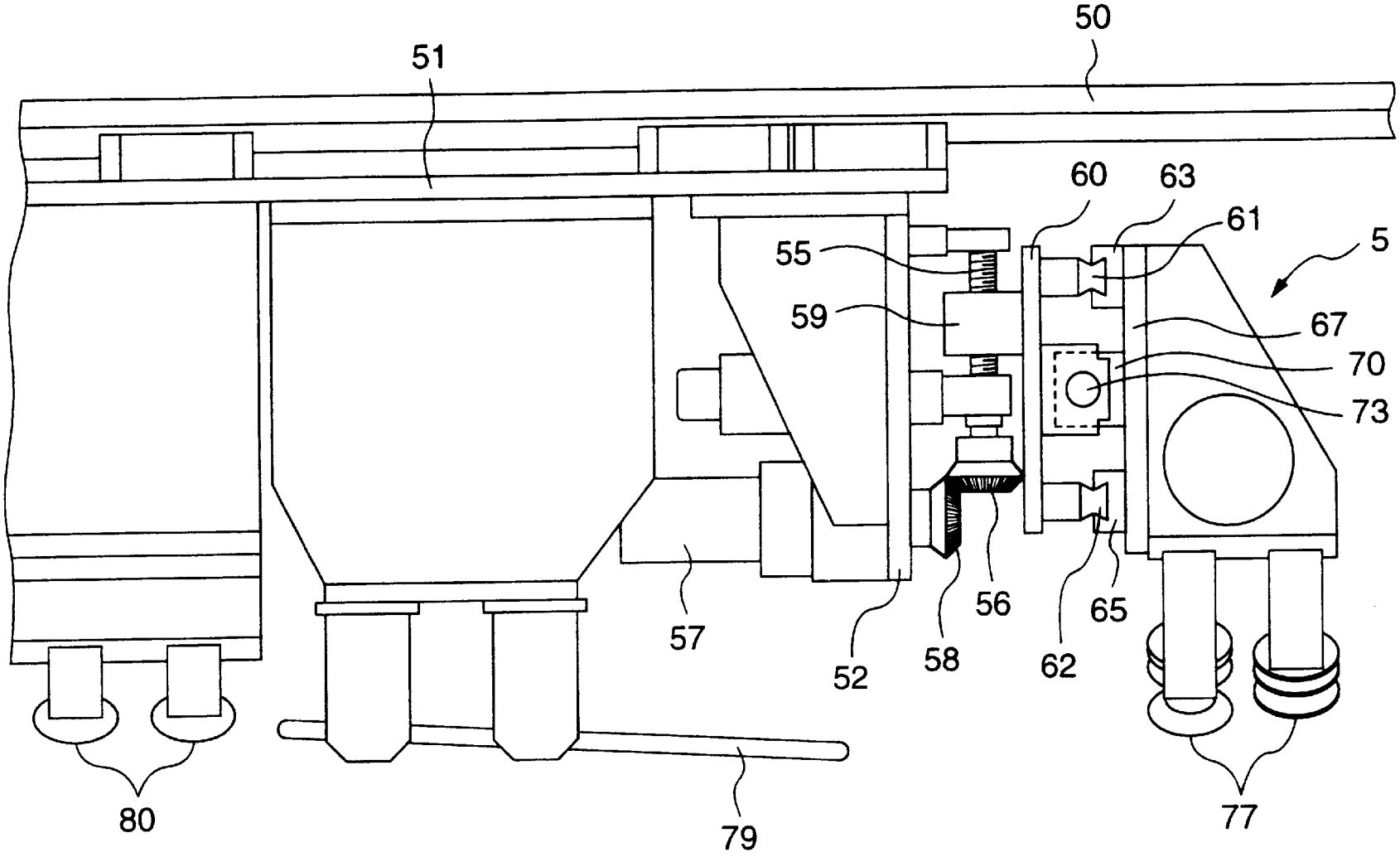
FIG. 8 is a side elevational view of a roll carriage applied to the present invention.

In FIG. 8, an arm plate 52 is vertically disposed at the extreme end portion of the support plate 51 and a screw shaft 55 is rotatably disposed forward of the arm plate 52 in the vertical direction through bearings and a bevel gear 56 is fixed to the lower end of the screw shaft 55. Further, the arm plate 52 includes a servo motor 57 acting as a rotational drive means and a bevel gear 58 fixed to the rotational drive shaft of the rotational drive means 57 is meshed with the bevel gear 56.

Figure 10:
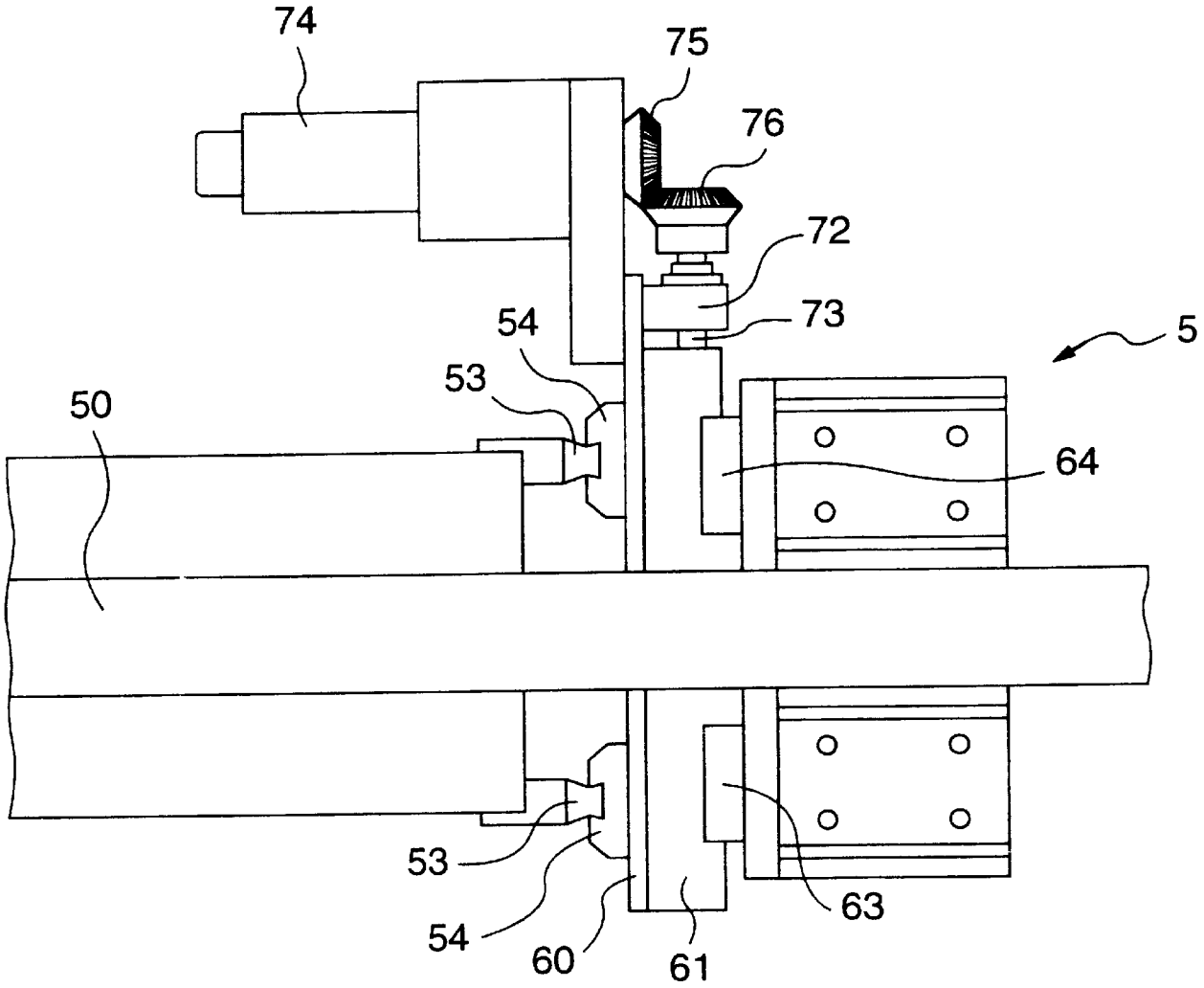
FIG. 10 is a plan view of the roll carriage in FIG. 8.
Figure 11A:
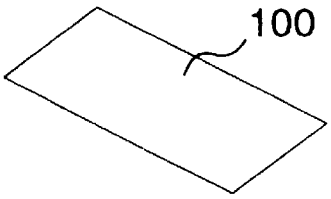
FIG. 11A to FIG. 11F are views showing the steps of a process for winding a sheet member around a shell case.
Figure 11B:
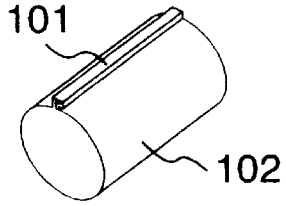
Figure 11C:
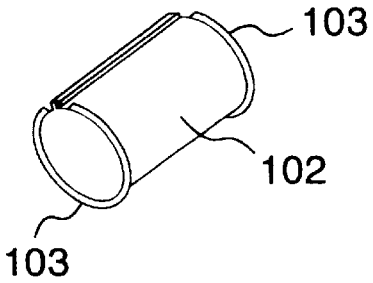
Figure 11D:
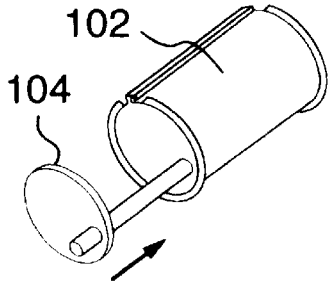
Figure 11E:
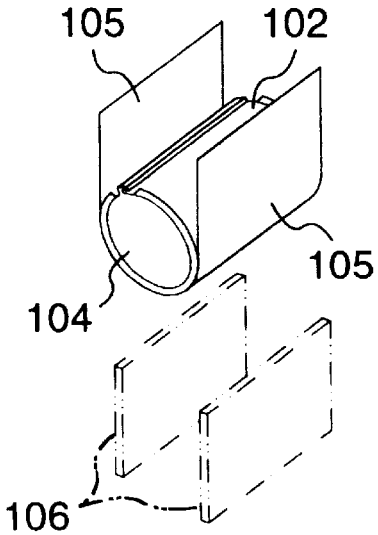
Figure 11F:
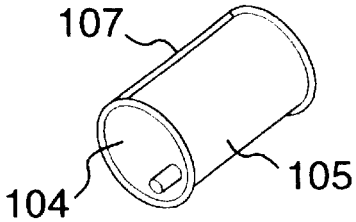
Figure 12A:
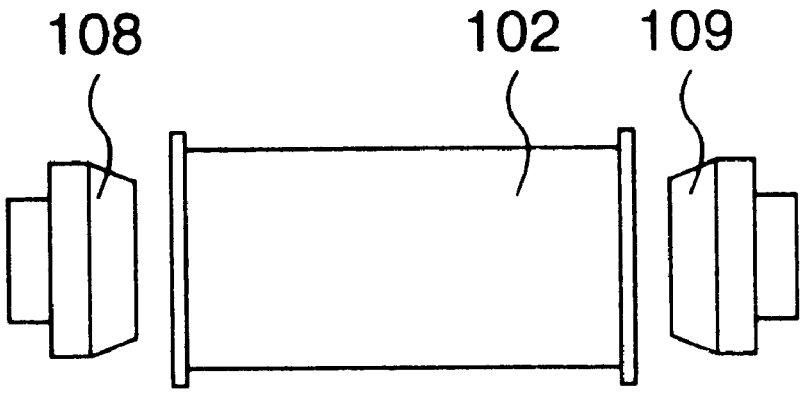
Figure 12B:
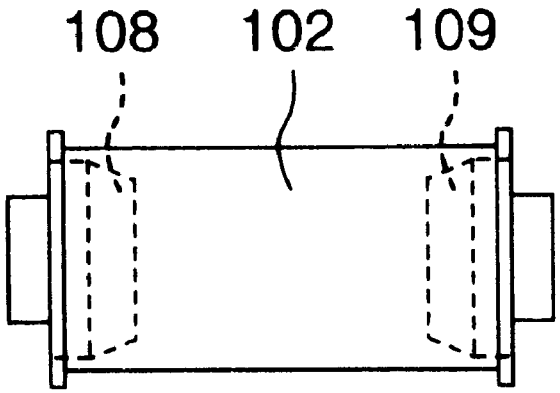

A lifting/lowering member 59 is screwed to the screw shaft 55 and a lifting/lowering plate 60 is disposed to the lifting/lowering member 59. As shown in FIG. 10, two vertical guide rails 53 are fixed to the front surface of the arm plate 52 and lifting/lowering members 54 which are slidingly engaged with the guide rails 53 are fixed to the back surface of the lifting/lowering plate 60.

Figure 9:
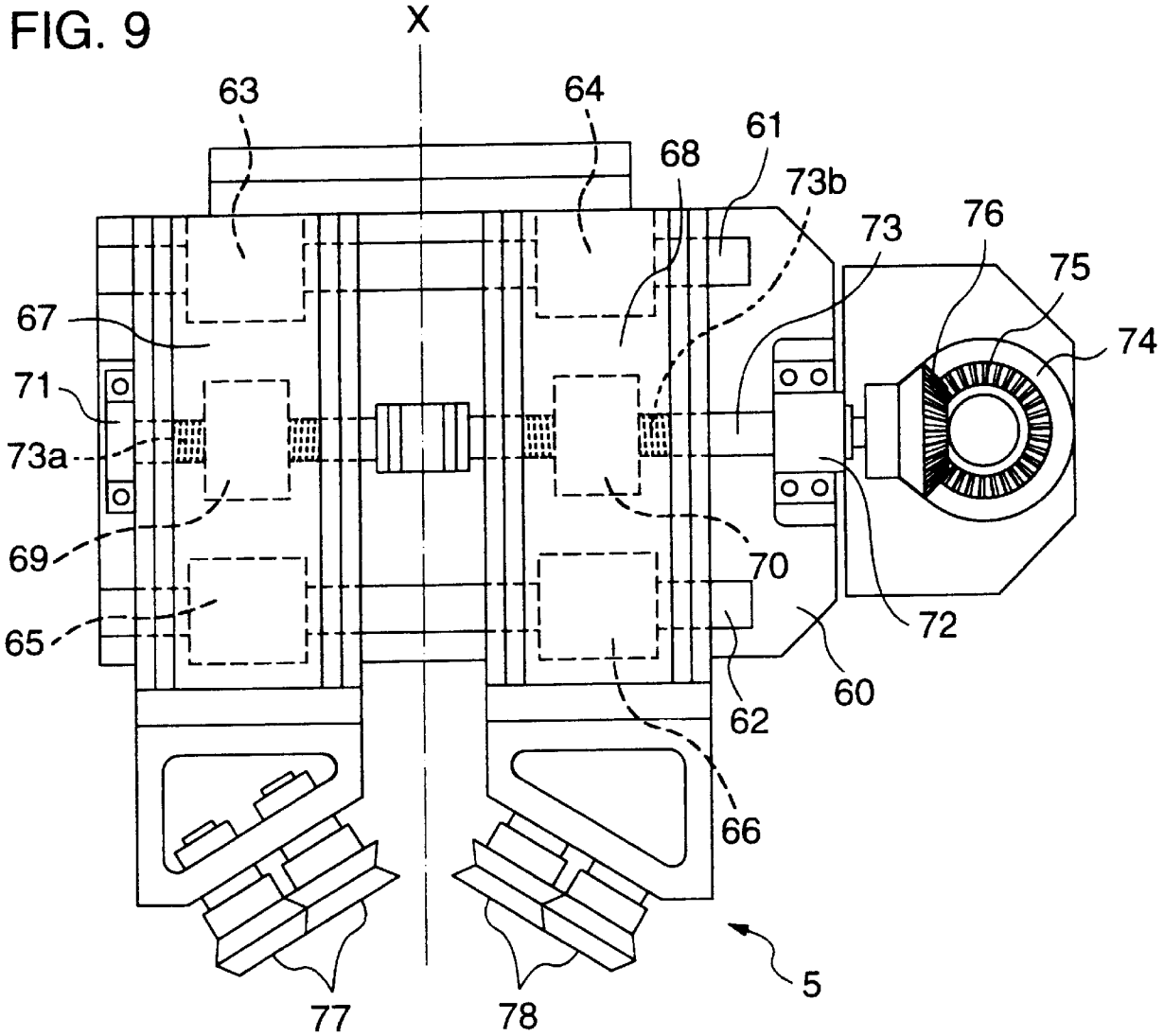
FIG. 9 is a view observed from a right side in FIG. 8.

Two guide rails 61, 62 are horizontally disposed to the front surface of the lifting/lowering plate 60 at an upper position and a lower position. As shown in FIG. 9, two upper moving members 63, 64 are located at right and left positions which are symmetrical with respect to the line X—X, and slidingly engaged with the upper guide rail 61. Further, two lower moving members 65, 66 are located at right and left positions which are symmetrical with respect to the line X—X, and slidingly engaged with the lower guide rail 62.

A left moving plate 67 is fixed between the upper moving member 63 and the lower moving member 65 and a right moving plate 68 is fixed between the upper moving member 64 and the lower moving member 66.

A left nut member 69 through which a female screw is horizontally engraved is fixed to the back surface of the left moving plate 67 and a right nut member 70 through which a female screw is horizontally engraved is fixed to the back surface of the right moving plate 68.

As shown in FIG. 9, a screw shaft 73 is rotatably disposed forward of the lifting/lowering plate 60 in the horizontal direction through bearings 71, 72 and a left screw 73*a* is engraved to the left side of the screw shaft 73 and a right screw 73*b* is engraved to the right side thereof. The left nut member 69 is screwed to the left screw 73*a* and the right nut member 70 is screwed to the right screw 73*b*.

The screw shaft 73 is normally and reversely rotated by a servo motor 74 as rotational drive means provided with the lifting/lowering plate 60 through both bevel gears 75, 76 as shown in FIG. 10.

In FIG. 9, left folding rolls 77 are disposed to the lower end of the left moving plate 67 and right folding rolls 78 are disposed to the lower end of the right moving plate 68. The left and right moving rolls 77, 78 are disposed symmetrically with respect to the line X—X as well as rotatably in an inclined state as shown in FIG. 9.

In FIG. 1 and FIG. 8, forming bars 79 similar to conventional ones are disposed below the support plate 51 and rearward of the folding rolls 77, 78 and a group of bending rolls 80 are disposed rearward of the forming bars 79. The support plate 51 is caused to advance and retreat along the rail 50 by not shown advancing/retreating means.

Next, the lower die apparatus 4 in FIG. 1 will be described with reference to FIG. 2.

Figure 2:
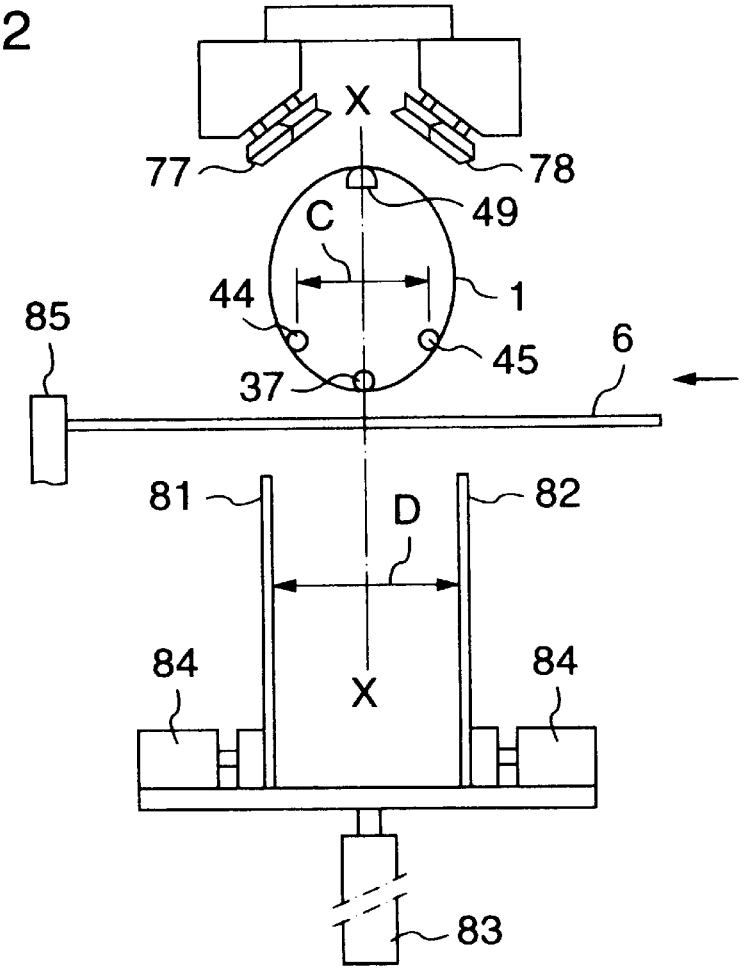
FIG. 2 is a schematic side elevational view in FIG. 1.

As shown in FIG. 2, the lower die apparatus 4 is disposed below the shell case 1 having been fed and includes two vertical presser plates 81, 82 disposed at positions which are symmetrical with respect to the line X—X, lifting/lowering drive means 83 for simultaneously lifting and lowering the two presser plates 81, 82 and drive means 84 for causing both the presser plates 81, 82 to become nearer to each other and to be separated from each other with respect to the line X—X.

In FIG. 2, numeral 85 denotes a stopper for positioning the plate member 6 having been fed.

The above respective drive means automatically drive the respective members by predetermined amounts when numerical values are input thereto.

Next, there is described a process for winding the sheet member 6 around the outer periphery of the shell case 1 serving as a inner cylinder.

First, a case that the shell case 1 serving as the inner shell has a small diametrical section as shown in FIG. 2 and FIG. 3 will be described.

In this case, the drive gear 13 is rotated in one direction by driving the servo motor 11 shown in FIG. 4 so that the lifting/lowering plates 17 is lifted by the rotation of the screw shaft 19. As a result, the first support member 37 is lifted until it comes into contact with the inner surface of the shell case 1 to be fed at a position just below the axial center of the shell case 1 as shown in FIG. 2 and FIG. 3. As the first support member 37 is lifted, the second and third support members 44, 45 are also lifted by the same amount.

Next, the pinion 31 is rotated in the one direction by driving the servo motor 32 to thereby move the first rack 46 in a right direction and the second rack 47 in a left direction in FIG. 5. As a result, the second support member 44 and the third support member 45 are moved so that they become nearer to each other and the interval C therebetween is set such that they come into contact with the inner surface of the shell case 1 to be fed at positions which are lower than a horizontal surface passing through the axial center of the shell case 1 to be fed.

Figure 7:
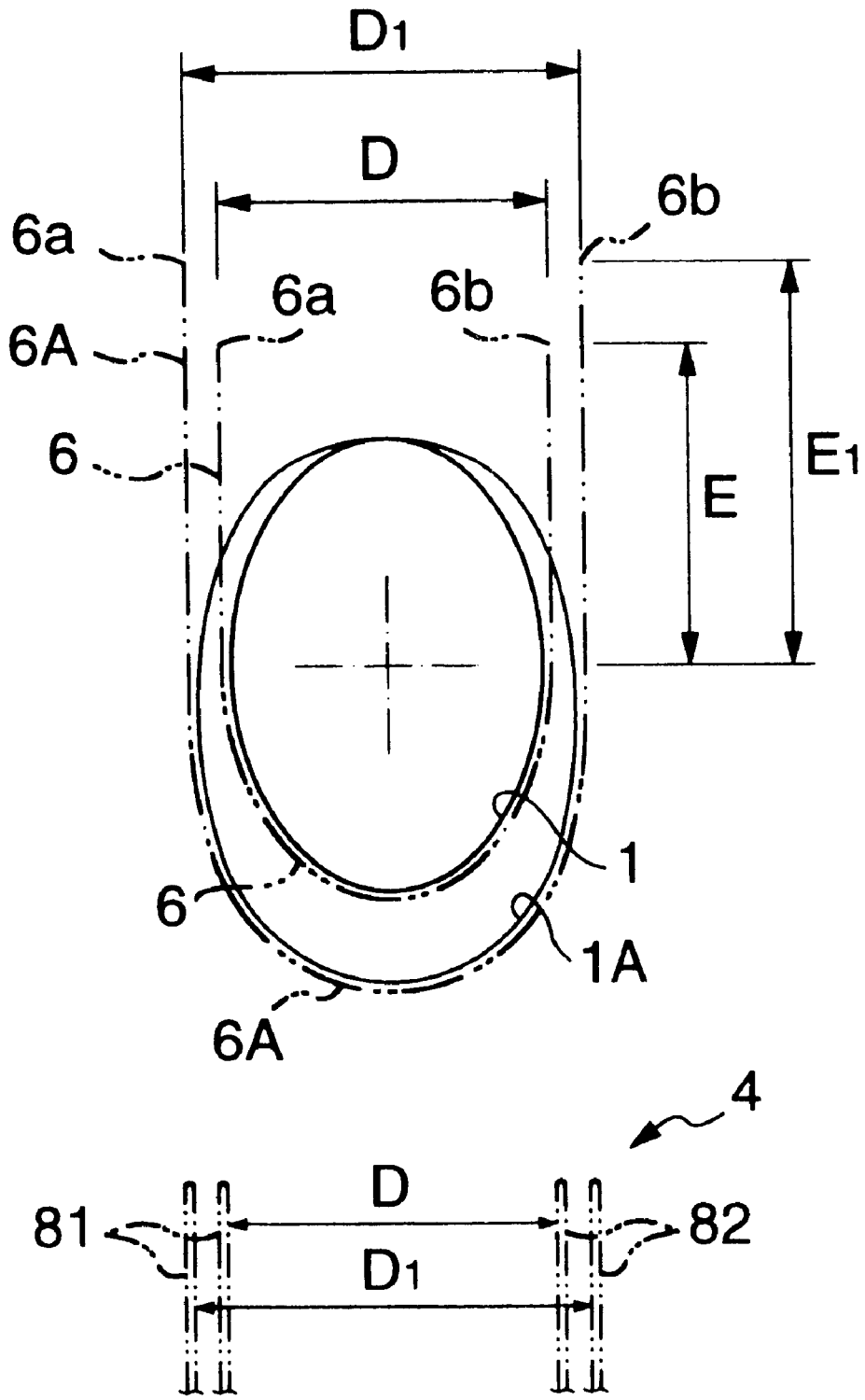
FIG. 7 is a view explaining how a sheet member is wound around a large shell case and a small shell case.

When the sheet member 6 is half wound around the shell case 1 which has the small diametrical section as shown in FIG. 7, the positions of both the ends 6*a*, 6*b* of the sheet member 6 are set such that the distance therebetween is D and the distance thereof from the axial center of the shell case 1 is E.

Therefore, the left and right folding rolls 77, 78 of the roll carriage 5 must be aligned with the above positions. This positional alignment is carried out in such a manner that the screw shaft 55 is rotated in the one direction by driving the servo motor 57 in FIG. 8 so that the left and right folding rolls 77, 78 are lowered to the positions where the above distance E is achieved as well as the screw shaft 73 is rotated in the one direction by driving the servo motor 74 so that the left and right bending rolls 77, 78 become nearer to each other to thereby achieve the interval D.

Further, as shown in FIG. 2 and FIG. 7, the interval between both the presser plates 81, 82 of the lower die apparatus 4 is set to the short diameter of the shell case 1, that is, to the interval D by the drive means 84.

In the state set as described above, first, the shell case 1 is horizontally fed between both the shell case support mechanisms 2, 3 by a robot or the like as shown in FIG. 1 and FIG. 2.

Next, both the shell case support mechanisms 2, 3 are moved toward the shell case 1 by drive means 9, the four support members 37, 44, 45 and 49 of the support mechanism 2 are inserted into the opening edge la of the shell case 1 and the support members 37*a*, 44*a*, 45*a* and 49*a* of the support mechanism 3 are inserted into the opening edge 1*b* thereof. With this operation, the respective support members comes into contact with the inner surface of the shell case 1 to thereby support the shell case 1 as shown in FIG. 2, by which the shell case 1 is centered.

Thereafter, the robot or the like retreats as well as the sheet member 6 is fed below the shell case 1 as shown in FIG. 2 and the presser plates 81, 82 of the lower die apparatus 4 are lifted by the lifting/lowering drive means 83.

When the presser plates 81, 82 are lifted, the sheet member 6 is wound around the approximately lower half of the shell case 1 and both the ends 6*a*, 6*b* of the sheet member 6 are raised as shown in FIG. 7.

Next, the roll carriage 5 advances toward the shell case 1 and both the ends 6*a*, 6*b* of the sheet member 6 are guided inward by the left and right folding rolls 77, 78 so that the sheet member 6 starts to be folded. Accordingly, the sheet member 6 are wound around the shell case 1 by the forming bars 79 and the group of the bending rolls 80 located backward and lock seamed. A silencer composed of inner and outer double shells is formed by the operation.

On the completion of the lock seam processing, the above respective mechanisms return to their original state, shell cases 1 are subsequently fed so that silencers are continuously made by repeating the above steps.

Next, a case that a shell case around which the sheet member 6 is wound has a diameter larger than the above shell case 1 as shown by numeral 1A in FIG. 3 will be described.

In this case, the servo motor 11 is driven in a direction opposite to the above direction from the above state of the small diameter to thereby reversely rotate the screw shaft 19 and lower the lifting/lowering base 17. As a result, the first support member 37 is lowered to a position 37A where it comes into contact with the lowermost inner surface of the large diameter shell case 1A to be fed. As the first support member 37 is lowered, the second and third support members 44, 45 are also lowered by the same amount.

Thereafter, the servo motor 32 is driven in a direction opposite to the above direction to thereby rotate the pinion 31 in a direction opposite to the above direction so that the first rack 46 and the second rack 47 are moved in a direction opposite to the above direction so as to move the second support member 44 and the third support member 45 in a direction in which they are separated from each other. As a result, the second support member 44 and the third support member 45 come into contact with the inner surface of the large diameter shell case 1A as shown by numerals 44A and 45A in FIG. 3.

As shown in FIG. 7, since a sheet member 6A to be wound around the shell case 1A having a large sectional area is longer as compared with that to be wound around the short diameter shell case 1, when the sheet member 6A is wound half the shell case 1A as shown in FIG. 7, the positions of both the ends 6*a*, 6*b* of the sheet member 6A are such that the distance D is increased to a disposed $D_1$ and the distance E is increased to a distance $E_1$ as compared with the case of the shell case 1 having the small section.

Therefore, the positions of the left and right folding rolls 77, 78 of the roll carriage 5 must be aligned with the positions $D_1$ and $E_1$. This positional alignment is carried out in such a manner that the servo motor 57 shown in FIG. 8 is driven in a direction opposite to the above direction to thereby rotate the screw shaft 55 in a direction opposite to the above direction so that the left and right folding rolls 77, 78 are lifted to positions where they are aligned with the positions of the above distance $E_1$. Further, the servo motor 74 is driven in a direction opposite to the above direction to thereby rotate the screw shaft 73 in a direction opposite to the above direction so that the left and right folding rolls 77, 78 are separated from each other so as to set the distance therebetween to the above distance $D_1$.

The distance between the presser plates 81, 82 of the lower die apparatus 4 is expanded by the drive means 84 and set to the distance $D_1$ which is as long as the short diameter $D_1$ of the large diameter shell case 1A as shown in FIG. 7.

After the completion of the above setting, both the opening edges of the shell case 1A having been fed are supported by the respective support members as well as the sheet member 6A is wound around the outer periphery of the shell case 1A and lock seamed by the same steps as above.

Although the above description is made as to the embodiment in which the sheet member is wound around the elliptical shell case, the present invention is also applicable to cases that a sheet member is wound around shell cases having various types of sectional shapes such as a circular shape, an oval shape, a rectangular shape and the like as well as to shell cases which have the above sectional shapes and are formed to a large section and a small section by combining the movement of the above respective support members in a vertical direction and a horizontal direction.

Although the four support members are provided with each of the support mechanisms in the above embodiment, various types of shell cases may be also supported in such an arrangement, for example, that only the first support member 37 and the fourth support member 49 are provided and the first support member 37 is moved in a direction perpendicular to the axial center of the shell case 1. There, the number of the support members is not limited to four but it suffices to provide the necessary number of support members.

Further, the second and third support members 44, 45 of the illustrated embodiment may be located to positions on the horizontal surface passing through the axial center of the shell case 1 or positions above the horizontal surface, in addition to the case that they are disposed below the horizontal surface passing through the axial center of the shell case 1 as shown in the illustrated embodiment.

As described above, according to the shell lock seaming machine of the first aspect of the invention, shell cases having a different sectional diameter as well as shell cases having a different sectional shape such as a circular shape, an elliptical shape, an oval shape, a rectangular shape and the like can be supported by a single type of the supporting mechanism. Thus, the shell lock seaming machine of the present invention is economical and can improve job efficiency and reduce a cost because a lot of mandrels need not be prepared and managed as compared with prior art which must replace mandrels each time a different type of a shell case is made.

Further, since the setup of the respective support members can be changed by moving them by drive means such as the motors and the like, a setup time can be greatly reduced and efficiency is enhanced.

As a result, the present invention is effective to manufacture many types of silencers by mixture.

According to the shell lock seaming machine of the second aspect of the invention, a shell case can be more stably supported.

According to the shell lock seaming machine of the third aspect of the invention, a shell case can be more stably supported and further it can be also centered.

What is claimed is:

1. A shell case support device for holding a shell case in a shell lock seaming machine, the shell case having openings at its opposed axial ends, the shell case support device comprising:

a pair of support mechanisms to support the shell case, said support mechanisms being disposed in spaced relation to each other to receive the shell case therebetween along its axis;

each of said support mechanisms having a plurality of support members to hold the shell case at an inner surface of one of the axial openings of the shell case, said plurality of support members being selectively movable in the axial direction of the shell case, and at least one of said plurality of support members being selectively movable in a direction perpendicular to the axis of the shell case;

whereby each said plurality of support members is selectively movable to engage and hold the shell case at the inner surface of the respective axial opening to thereby support the shell case for lock seaming.

2. A shell case support device according to claim 1, wherein said support mechanisms are disposed to receive the shell case with its axis in a generally horizontal disposition, and each said plurality of support members includes an upper support member disposed to engage the shell case above its axial center, said upper support member being selectively movable axially, a lower support member disposed to engage the shell case below its axial center, said lower support member being selectively moveable axially and in a generally vertical direction, and a plurality of intermediate support members, said intermediate support members being disposed intermediate said upper and lower support members and being moveable axially and perpendicularly to the axis of the shell case.

3. A shell case support device according to claim 2, wherein said plurality of intermediate support members includes a pair of intermediate support members disposed to engage the shell case on opposing sides of the axial center of the shell case and below the axial center of the shell case.

* * * * *